US008610629B2

(12) United States Patent
Pascolini et al.

(10) Patent No.: US 8,610,629 B2
(45) Date of Patent: Dec. 17, 2013

(54) HOUSING STRUCTURES FOR OPTIMIZING LOCATION OF EMITTED RADIO-FREQUENCY SIGNALS

(75) Inventors: Mattia Pascolini, Campbell, CA (US); Robert W. Schlub, Cupertino, CA (US); Ruben Caballero, San Jose, CA (US); Nanbo Jin, Sunnyvale, CA (US); Scott Myers, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 743 days.

(21) Appl. No.: 12/789,400

(22) Filed: May 27, 2010

(65) Prior Publication Data

US 2011/0291896 A1 Dec. 1, 2011

(51) Int. Cl.
*H01Q 1/24* (2006.01)

(52) U.S. Cl.
USPC ..... 343/702; 343/700 MS

(58) Field of Classification Search
USPC ..... 343/700, 702, 767, 770, 846, 848
See application file for complete search history.

(56) References Cited

U.S. PATENT DOCUMENTS

| | | | | |
|---|---|---|---|---|
| 6,031,503 | A * | 2/2000 | Preiss et al. | 343/770 |
| 6,462,714 | B1 * | 10/2002 | Okabe et al. | 343/767 |
| 6,476,767 | B2 | 11/2002 | Aoyama et al. | |
| 6,483,466 | B2 * | 11/2002 | Liu | 343/702 |
| 6,985,108 | B2 * | 1/2006 | Mikkola et al. | 343/700 MS |
| 7,042,418 | B2 | 5/2006 | Fujimura et al. | |
| 7,072,623 | B2 | 7/2006 | Harano | |
| 7,173,567 | B2 | 2/2007 | Inatsugu et al. | |
| 7,629,930 | B2 | 12/2009 | Murch et al. | |
| 2003/0193437 | A1 | 10/2003 | Kangasvieri et al. | |
| 2004/0257283 | A1 | 12/2004 | Asano et al. | |
| 2006/0109184 | A1 | 5/2006 | Chen et al. | |
| 2008/0316115 | A1 * | 12/2008 | Hill et al. | 343/702 |
| 2009/0058358 | A1 | 3/2009 | Inoue et al. | |
| 2010/0123632 | A1 | 5/2010 | Hill et al. | |

FOREIGN PATENT DOCUMENTS

| | | |
|---|---|---|
| CN | 1682406 | 10/2005 |
| CN | 1776962 | 5/2006 |
| DE | 10248756 | 3/2004 |
| EP | 1093098 | 4/2001 |
| EP | 1324425 | 7/2003 |
| EP | 2058716 | 5/2009 |
| TW | M311134 | 5/2007 |
| TW | I322388 | 3/2010 |

* cited by examiner

*Primary Examiner* — Tho G Phan
(74) *Attorney, Agent, or Firm* — Treyz Law Group; G. Victor Treyz; Michael H. Lyons

(57) ABSTRACT

Electronic devices are provided that contain wireless communications circuitry. The wireless communications circuitry may include radio-frequency transceiver circuitry and antenna structures. A display may be mounted on a front face of an electronic device. A conductive member such as a bezel may surround the display. Internal housing support structures such as a metal midplate member may be used to support the display. The midplate member may be connected between opposing edges of the bezel. The antenna structures may include an antenna formed from part of the midplate member and part of the bezel. Antenna image currents in the midplate member may be blocked by slots in the midplate member. The slots may be located adjacent to the antenna and may ensure that the antenna emits radio-frequency signals in a desired pattern. The slots may be angled and segmented.

20 Claims, 10 Drawing Sheets

HOUSING STRUCTURES FOR OPTIMIZING LOCATION OF EMITTED RADIO-FREQUENCY SIGNALS

BACKGROUND

This relates generally to wireless communications circuitry, and more particularly, to electronic devices that have wireless communications circuitry.

Electronic devices such as handheld electronic devices are becoming increasingly popular. Examples of handheld devices include handheld computers, cellular telephones, media players, and hybrid devices that include the functionality of multiple devices of this type.

Devices such as these are often provided with wireless communications capabilities. For example, electronic devices may use long-range wireless communications circuitry such as cellular telephone circuitry to communicate using cellular telephone bands at 850 MHz, 900 MHz, 1800 MHz, and 1900 MHz (e.g., the main Global System for Mobile Communications or GSM cellular telephone bands). Long-range wireless communications circuitry may also handle the 2100 MHz band. Electronic devices may use short-range wireless communications links to handle communications with nearby equipment. For example, electronic devices may communicate using the WiFi® (IEEE 802.11) bands at 2.4 GHz and 5 GHz and the Bluetooth® band at 2.4 GHz.

To satisfy consumer demand for small form factor wireless devices, manufacturers are continually striving to implement wireless communications circuitry such as antenna structures using compact structures. At the same time, it may be desirable to form an electronic device from conductive structures such as conductive housing structures. Because conductive materials can affect radio-frequency performance, care must be taken when incorporating antenna resonating elements and other conductive structures into an electronic device. For example, antennas and associated conductive structures should be configured so that emitted radio-frequency signal powers remain below regulatory limits.

It would therefore be desirable to be able to provide improved antenna structures for electronic devices.

SUMMARY

An electronic device may be provided that has wireless communications circuitry. The wireless communications circuitry may include one or more antennas. The antennas may be formed from conductive structures within the electronic device.

The electronic device may be a portable electronic device with a rectangular housing. A display may be provided on the front surface of the housing. A conductive metal member such as a bezel may run along each of the four edges of the housing, surrounding the display.

Internal support structures such as an internal metal plate may be used to provide the electronic device with structural support. For example, an internal metal plate may be used to support the display. The internal metal plate may be connected to the conductive metal member along a pair of opposing edges. For example, the internal metal plate may be connected at least to left and right edges of the conductive metal member.

The conductive structures from which the antennas are formed may include portions of the conductive metal member and portions of the internal metal plate. For example, an antenna may be formed from a portion of the conductive metal member and a portion of the internal metal plate. These structures may be separated from each other by a dielectric region.

As the antenna operates, antenna currents may circulate around the dielectric region. At the same time, antenna image currents may be induced in the conductive metal member. The location of these antenna image currents can influence the location at which antenna signals are emitted from the electronic device.

Elongated slots (grooves) or other openings may be formed in the internal metal plate to adjust the location of emitted antenna signals. For example, a series of diagonally oriented segmented grooves may be formed in the internal metal plate that are adjacent to the antenna and the dielectric region. These slots may influence the location of antenna image currents during antenna operation. The inclusion of the grooves may help ensure that antenna signals are not emitted too near the center of the electronic device and satisfy regulatory limits on emitted antenna signal powers.

Further features of the invention, its nature and various advantages will be more apparent from the accompanying drawings and the following detailed description of the preferred embodiments.

DETAILED DESCRIPTION

Electronic devices may be provided with wireless communications circuitry. The wireless communications circuitry may be used to support wireless communications in multiple wireless communications bands. The wireless communications circuitry may include one or more antennas.

The antennas can be based on any suitable type of antenna architecture. For example, antenna structures can be formed from patch antennas, coil antennas, inverted-F antennas, planar inverted-F antennas, slot antennas, strip antennas, monopoles, dipoles, loop antennas, other suitable antennas, hybrid antennas that include structures associated with more than one of these antenna structure types, etc.

Antenna structures such as these may be provided in electronic devices such as desktop computers, game consoles, routers, laptop computers, etc. With one suitable configuration, these antenna structures may be provided in relatively compact electronic devices such as portable electronic devices.

Figure 1:
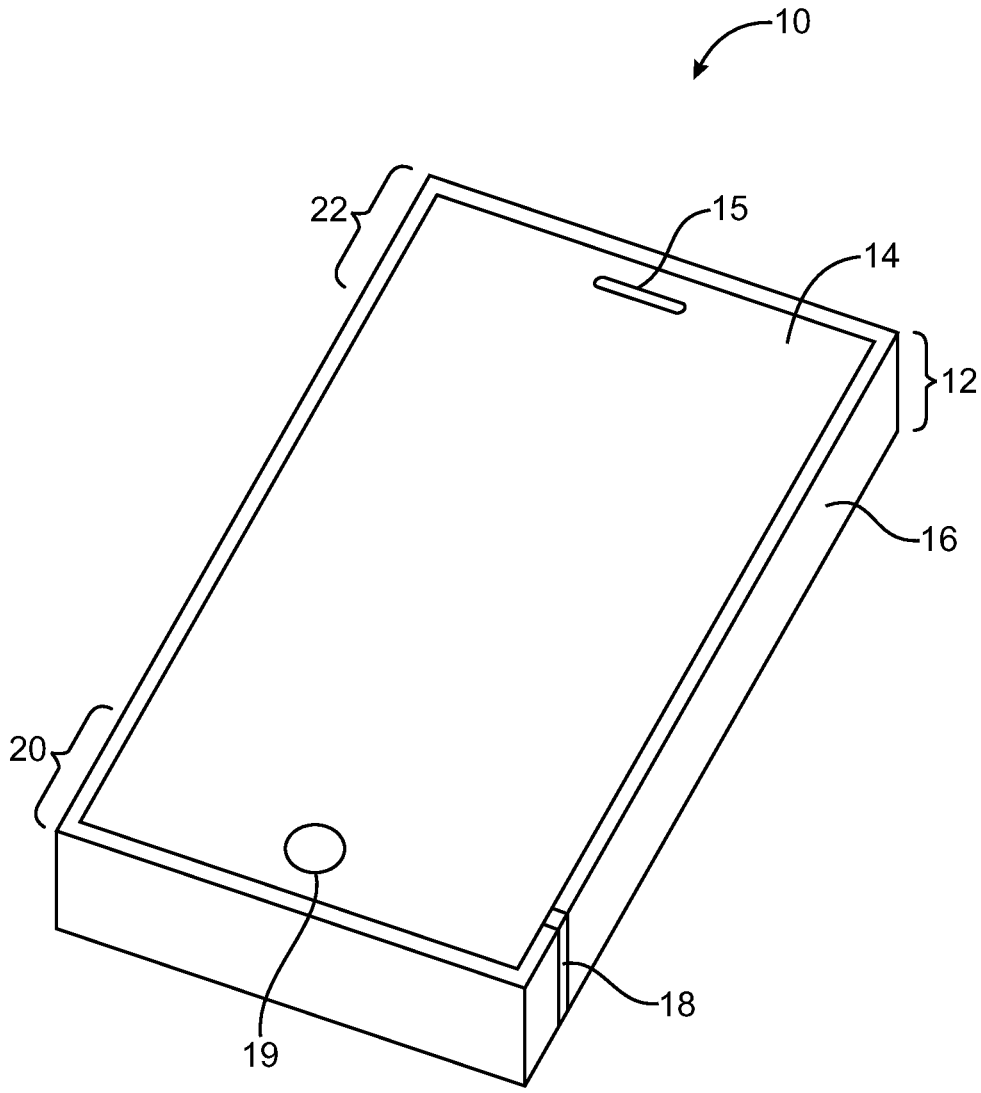
FIG. 1 is a perspective view of an illustrative electronic device with wireless communications circuitry in accordance with an embodiment of the present invention.

An illustrative portable electronic device that may include antennas is shown in FIG. 1. Portable electronic devices such as illustrative portable electronic device 10 of FIG. 1 may be laptop computers or small portable computers such as ultraportable computers, netbook computers, and tablet computers. Portable electronic devices such as device 10 may also be somewhat smaller devices. Examples of smaller portable electronic devices include wrist-watch devices, pendant devices, headphone and earpiece devices, and other wearable and miniature devices. With one suitable arrangement, portable electronic device 10 may be a handheld electronic device such as a cellular telephone or music player.

Device 10 includes housing 12 and includes at least one antenna for handling wireless communications. Housing 12, which is sometimes referred to as a case, may be formed of any suitable materials including, plastic, glass, ceramics, composites, metal, or other suitable materials, or a combination of these materials. In some situations, parts of housing 12 may be formed from dielectric or other low-conductivity material, so that the operation of conductive antenna elements that are located within housing 12 is not disrupted. In other situations, housing 12 may be formed from metal elements.

Device 10 may have a display such as display 14. Display 14 may be a touch screen that incorporates capacitive touch electrodes or other touch sensitive elements. Display 14 may include image pixels formed form light-emitting diodes (LEDs), organic LEDs (OLEDs), plasma cells, electronic ink elements, liquid crystal display (LCD) components, or other suitable image pixel structures. A cover glass member may cover the surface of display 14. Buttons such as button 19 and speaker ports such as speaker port 15 may be formed in openings in the cover glass.

Housing 12 may include sidewall structures such as sidewall structures 16. Some or all of structures 16 may be formed using conductive materials. For example, structures 16 may be implemented using a conductive ring-shaped band member that substantially surrounds the rectangular periphery of display 14. Structures 16 may be formed from a metal such as stainless steel, aluminum, or other suitable materials. One, two, or more than two separate structures may be used in forming structures 16. Structures 16 may serve as a bezel that holds display 14 to the front (top) face of device 10 and/or that serves as a cosmetic trim piece for display 14. Structures 16 are therefore sometimes referred to as a bezel or as bezel structures.

It is not necessary for bezel 16 to have a uniform cross-section. For example, the top portion of bezel 16 may, if desired, have an inwardly protruding lip that helps hold display 14 in place. If desired, the bottom portion of bezel 16 may also have an enlarged lip (e.g., in the plane of the rear surface of device 10). In the example of FIG. 1, bezel 16 has substantially straight vertical sidewalls. This is merely illustrative. The sidewalls of bezel 16 may be curved or may have any other suitable shape.

Portions of bezel 16 may be provided with gap structures. For example, bezel 16 may be provided with one or more gaps such as gap 18, as shown in FIG. 1. Gap 18 lies along the periphery of the housing of device 10 and display 12 and is therefore sometimes referred to as a peripheral gap. Gap 18 may divide bezel 16 (i.e., so there is no conductive portion of bezel 16 in gap 18).

As shown in FIG. 1, gap 18 may be filled with dielectric. For example, gap 18 may be filled with air. To help provide device 10 with a smooth uninterrupted appearance and to ensure that bezel 16 is aesthetically appealing, gap 18 may be filled with a solid (non-air) dielectric such as plastic. Bezel 16 and gaps such as gap (and its associated plastic filler structure) may form part of one or more antennas in device 10. For example, portions of bezel 16 and gaps such as gap 18 may, in conjunction with internal conductive structures, form one or more loop antennas. The internal conductive structures may include printed circuit board structures, conductive planar internal support members such as planar metal midplate members, conductive frame structures, or other suitable conductive structures.

In a typical scenario, device 10 may have upper and lower antennas (as an example). An upper antenna may, for example, be formed at the upper end of device 10 in region 22. A lower antenna may, for example, be formed at the lower end of device 10 in region 20.

Antennas in device 10 such as the antennas in regions 22 and 20 may be used to support any communications bands of interest. For example, device 10 may include antenna structures for supporting local area network communications, voice and data cellular telephone communications, global positioning system (GPS) communications, Bluetooth® communications, etc. As an example, the lower antenna in region 20 of device 10 may be used in handling voice and data communications in one or more cellular telephone bands.

For satisfactory operation, the antennas of device 10 in regions 22 and 20 (e.g., the antenna structures formed from bezel 16 and internal conductive housing structures) should support the transmission and reception of radio-frequency antenna signals with desired efficiencies while simultaneously complying with regulatory limits for emitted powers.

These constraints can pose antenna design challenges. For example, image currents may be induced within internal conductive housing structures during operation of an antenna. Care should be taken to ensure that the image currents do not result in emitted radio-frequency signal powers that exceed regulatory limits.

With one suitable arrangement, grooves or other openings may be formed within the internal conductive housing structures of device 10 to control the distribution of image currents. This may help ensure that emitted radio-frequency signal powers comply with regulatory limits.

Figure 2:
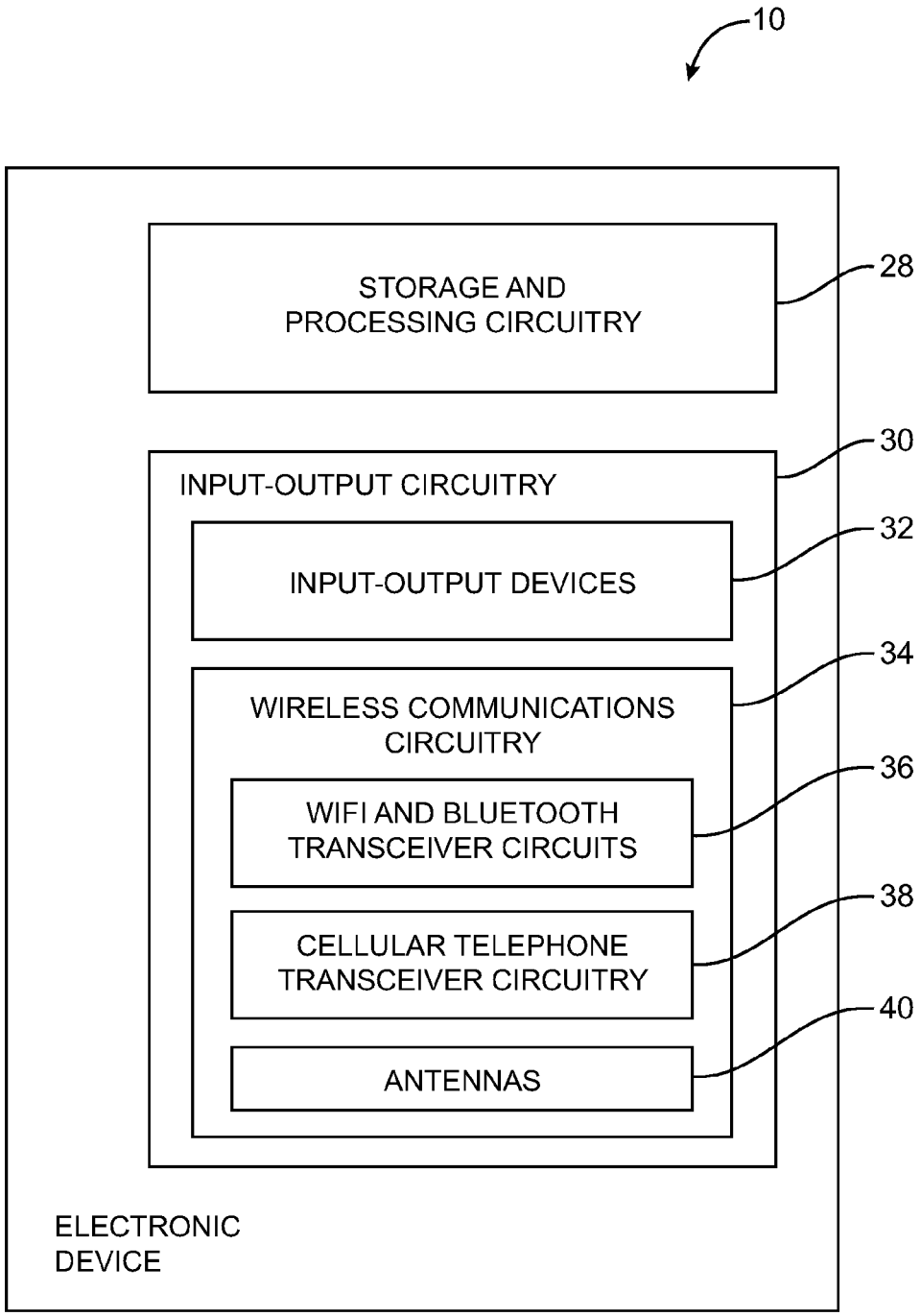
FIG. 2 is a schematic diagram of an illustrative electronic device with wireless communications circuitry in accordance with an embodiment of the present invention.

A schematic diagram of illustrative electronic components that may be used within device 10 of FIG. 1 is shown in FIG. 2. As shown in FIG. 2, device 10 may include storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, applications specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Input-output circuitry 30 may be used to allow data to be supplied to device 10 and to allow data to be provided from device 10 to external devices. Input-output devices 32 such as touch screens and other user input interface are examples of input-output circuitry 32. Input-output devices 32 may also include user input-output devices such as buttons, joysticks, click wheels, scrolling wheels, touch pads, key pads, keyboards, microphones, cameras, etc. A user can control the operation of device 10 by supplying commands through such user input devices. Display and audio devices such as display 14 (FIG. 1) and other components that present visual information and status data may be included in devices 32. Display and audio components in input-output devices 32 may also include audio equipment such as speakers and other devices for creating sound. If desired, input-output devices 32 may contain audio-video interface equipment such as jacks and other connectors for external headphones and monitors.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications). Wireless communications circuitry 34 may include radio-frequency transceiver circuits for handling multiple radio-frequency communications bands. For example, circuitry 34 may include transceiver circuitry 36 and 38. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as the GSM bands at 850 MHz, 900 MHz, 1800 MHz, and 1900 MHz, and the 2100 MHz data band (as examples). Wireless communications circuitry 34 can include circuitry for other short-range and long-range wireless links if desired. For example, wireless communications circuitry 34 may include global positioning system (GPS) receiver equipment, wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structure, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link.

With one suitable arrangement, which is sometimes described herein as an example, the lower antenna in device (i.e., one of antennas 40 that is located in region 20 of device 10 of FIG. 1) may be formed using a loop-type antenna design.

Figure 3:
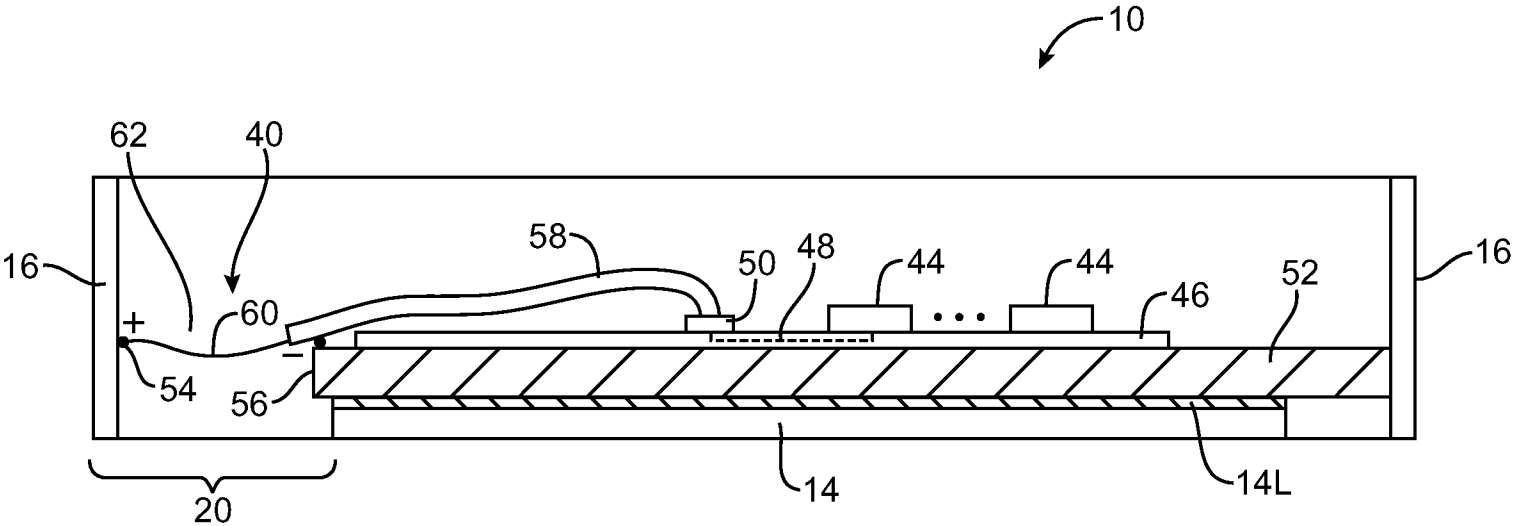
FIG. 3 is a cross-sectional side view of an illustrative electronic device with wireless communications circuitry in accordance with an embodiment of the present invention.

A cross-sectional side view of device 10 of FIG. 1 taken is shown in FIG. 3. Display 14 may be mounted to the front surface of device 10.

Display 14 may be mounted within device 10 using internal support structures. With one suitable arrangement, which is sometimes described herein as an example device 10 may be provided with one or more planar metal structural elements such as structure 52 on which display 14 may rest. Adhesive or fasteners may be used to mount display 14 on structure 52. During use of display 14 (i.e., when a user presses on the surface of display 14 to make a touch screen selections), display 14 may tend to flex. By mounting display 14 so that display 14 rests on structure 52 and is supported by structure 52, display 14 will be prevented from bending undesirably. Structure 52 may have an area that is substantially equal to that of display 14 or may be larger than that of display 14 (e.g., structure 52 may be a member that extends under substantially all of the planar area occupied by display 14 to prevent display 14 from flexing).

Structures 52 may extend across substantially all of the width of device 10 under display 14 (i.e., from the left edge of device 10 in FIG. 1 to the opposing right edge of device 10 in FIG. 1). Structure 52 may have a substantially planar shape. For example, structure 52 may have a substantially rectangular plate shape. Accordingly, structures such as illustrative structure 52 of FIG. 3 may sometimes be referred to as a support plates, planar support structures, midplates, etc. Structure 52 (i.e., the midplate of device 10) may be formed from a sheet of metal such as stainless steel or aluminum (as examples).

Welds, solder, screws or other fasteners, engagement features such as springs and clips, adhesive (e.g., conductive adhesive), or other coupling mechanisms may be used to attach midplate 52 to bezel 16. For example, midplate 52 may be welded to bezel 16 around some of the periphery of midplate 52, where midplate touches bezel 16. The presence of the midplate in device 10 may help strengthen device 10 and thereby protect the components of device 10 from damage. For example, midplate 52 may serve as a support for bezel 16, display 14, printed circuit boards, an audio jack and other connectors, and other components. The use of welds and other fastening mechanisms may electrically short midplate 52 to bezel 16.

The outermost layers of display 14 may include structures such as image pixels formed from liquid crystal structures, thin-film transistors for controlling image pixels, touch sensor electrodes, and cover glass. Lower portions of display 14 such as layer 14L may contain a reflector and other backlight structures. Many of these structures in display 14 (e.g., the structures shown in FIG. 3) are conductive and can affect the way in which radio-frequency antenna signals are emitted from antenna 40 in region 20. For example, a thin metal layer may be used as part of a rear reflector in backlight structures 14L. The presence of these conductive display structures can affect antenna performance.

In a typical arrangement, antenna performance is more affected by the size and shape of midplate 52 than the size and shape of display 14, because plate 52 is generally much more conductive than the conductive layers of display 14. This is because midplate 52 is preferably formed from a relatively thick plate of metal (e.g., metal that is 0.1 to 3 mm thick, that is 0.2 to 2 mm thick, etc.). The metal that is used in forming midplate 52 may, for example, be stainless steel or aluminum. In an arrangement of this type, the presence of midplate 52 or other such conductive structural members should be taken into account, because the size, shape, and location of these structures are dominant factors in determining how the antennas of device 10 will perform.

In the illustrative arrangement shown in FIG. 3, a lower antenna for device 10 has been formed in region 20. This lower antenna (i.e., one of antennas 40 of FIG. 2) may be fed using an antenna feed having terminals such as positive antenna feed terminal 54 and ground (negative) antenna feed terminal 56. The antenna may be formed using parts of housing 12 such as parts of conductive bezel 16 and parts of midplate 52. Other conductive structures in device 10 such as printed circuit board traces and strips of metal may also affect antenna performance and may therefore be said to form part of the antenna.

A matching network may be used to help match the impedance of transmission line 58 to the antenna feed. Transmission line 58 may be, for example, a coaxial cable or a microstrip transmission line having an impedance of 50 ohms (as an example). The matching network may be formed from components such as inductors, resistors, and capacitors. These components may be provided as discrete components (e.g., surface mount technology components). Matching network components and antenna structures may also be formed from housing structures and other parts of device 10. For example, gaps such as gap 18 (FIG. 1) may affect antenna performance.

Device 10 may contain printed circuit boards such as printed circuit board 46. Printed circuit board 46 and the other printed circuit boards in device 10 may be formed from rigid printed circuit board material (e.g., fiberglass-filled epoxy) or flexible sheets of material such as polymers. Flexible printed circuit boards ("flex circuits") may, for example, be formed from flexible sheets of polyimide.

Printed circuit board 46 may contain interconnects such as interconnects 48. Interconnects 48 may be formed from conductive traces (e.g., traces of gold-plated copper or other metals). Connectors such as connector 50 may be connected to interconnects 48 using solder or conductive adhesive (as examples). Integrated circuits, discrete components such as resistors, capacitors, and inductors, and other electronic components may be mounted to printed circuit board 46. These components are shown as components 44 in FIG. 3.

Components 44 may include one or more integrated circuits that implement transceiver circuits 36 and 38 of FIG. 2. Connector 50 may be, for example, a coaxial cable connector that is connected to printed circuit board 46. Cable 58 may be a coaxial cable or other transmission line. Terminal 54 may be connected to coaxial cable center connector 60. Terminal 56 may be connected to a ground conductor in cable 58 (e.g., a conductive outer braid conductor) and may also be electrically connected to midplate 52, so that portions of midplate 52 serve as antenna ground.

Region 62 between the lower edge of midplate 52 and the nearby portion of bezel 16 forms a dielectric region (opening) that separates part of bezel 16 and midplate 52. With this type of arrangement, the part of bezel 16 and midplate 52 that surround the periphery of opening 62 may form a loop or slot antenna. Other antenna types may be formed in region 20 if desired. The use of loop or slot antenna formed from portions of bezel 16 and midplate 52 in region 20 of device 10 is merely illustrative.

Figure 4:
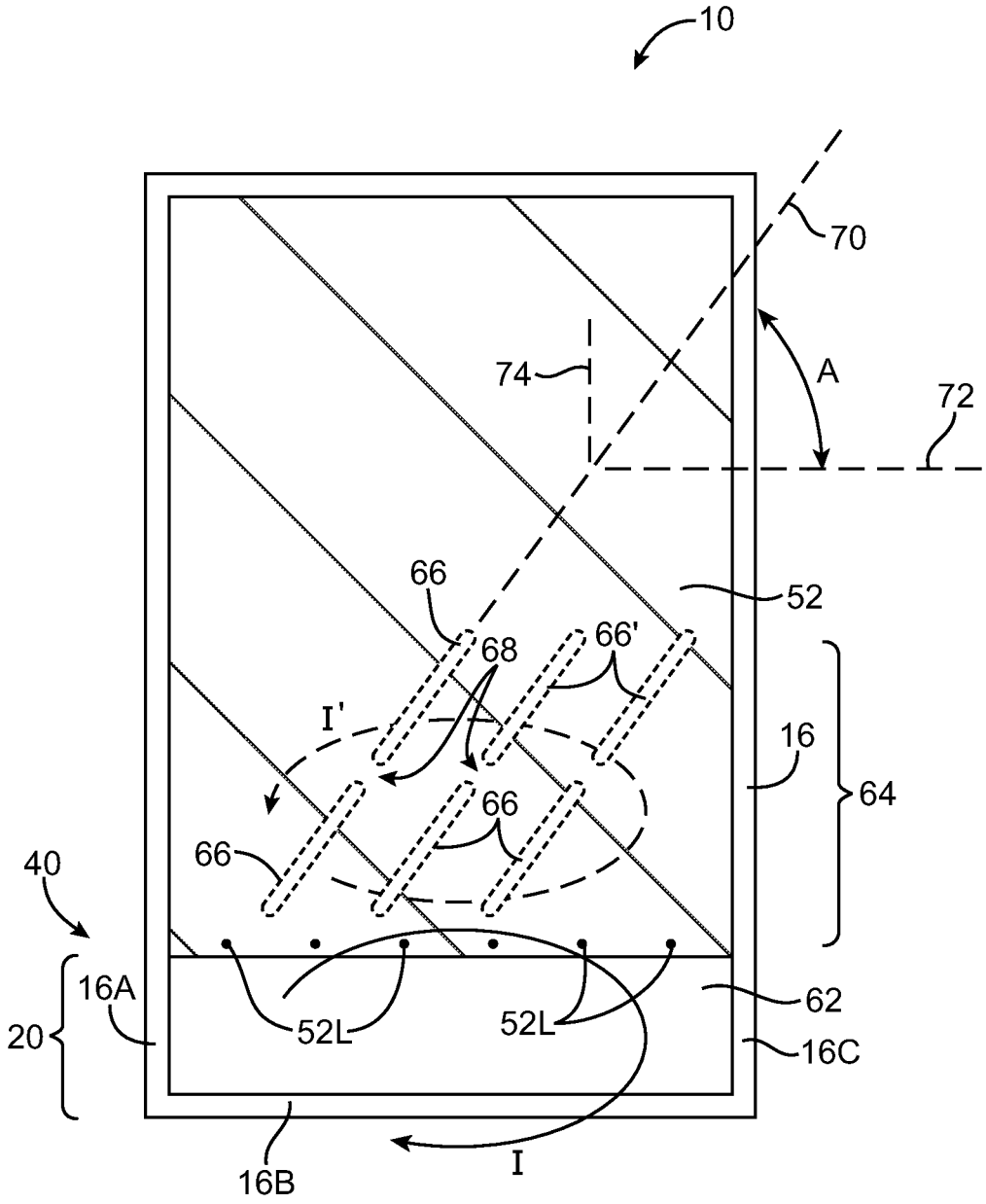
FIG. 4 is a top view of an electronic device showing how an internal housing structure such as a midplate member may be provided with openings such as angled grooves to adjust the pattern of radio-frequency antenna signals emitted from the electronic device in accordance with an embodiment of the present invention.

FIG. 4 is a top view of device 10 showing how portions of midplate 52 and bezel 16 that surround opening 62 may form antenna 40 in region 20. Midplate 52 is typically located within the interior of device 10. In a completed product, covering layers such as a glass cover layer on the front planar surface of device 10 (as shown in FIG. 1) and a dielectric layer such as plastic, glass, or ceramic on the rear planar surface of device 10 may be used to enclose midplate 52 and other internal housing structures within device 10. Other materials may be used to form these covering structures if desired. An advantage of forming at least portions of the covering structures in the vicinity of antenna region 20 from dielectric is that this allows antenna signals to be conveyed to and from antenna 40.

During antenna operation, radio-frequency antenna signals develop in the conductive structures of antenna 40. For example, current I may develop within portion 52L of midplate 52, and bezel portions 16C, 16B, and 16A. As shown in FIG. 4, portion 52L of midplate 52 may be formed from a strip of midplate 52 that is adjacent to opening 62.

Edge 52L of midplate 52 may be considered to form the beginning of a relatively large ground plane (formed from the rest of midplate 52 and overlapping conductive structures such as display structures 14). Because of the presence of this ground plane, the flow of current I tends to induce a corresponding image current I' in midplate 52. The image current I', which tends to circulate in the opposite direction from antenna current I is associated with emitted radio-frequency antenna signals (i.e., antenna image current I' tends to form an image antenna in region 64). If not controlled, this image antenna can cause radio-frequency antenna signals to be emitted from device 10 in an undesired pattern.

To control the way in which radio-frequency antenna signals are emitted from antenna 40 during operation, midplate 54 may be provided with slots (grooves) 66 or other suitable openings in region 64. The presence of these openings influences the flow of image currents I' by blocking current flow where the openings are located. This helps ensure that radio-frequency antenna signals will only be emitted where desired.

In the example of FIG. 4, openings 66 have been formed by creating elongated slots (grooves) in midplate 52, starting adjacent to region 52L of midplate 52 and extending longitudinally along and parallel to diagonal axis 70. Axis 70 may be oriented at any suitable angle relative to horizontal axis 72 (which represents the transverse axis of device 10) and vertical axis 74 (which represent the longitudinal axis of device 10). For example, axis 70 may be oriented at an angle A of 40° to 85° relative to horizontal axis 72. Other types of configurations may be used for openings 66 if desired. The arrangement of FIG. 4 is merely illustrative.

In general, openings 66 may be provided with any suitable shape that adjusts the flow of image current I' and therefore controls the antenna signals emitted from antenna 40. For example, openings 66 may be formed from circles, ovals, rectangles, other polygons, combinations of polygons and grooves, straight slots, angled slots, curved slots, slots with relatively wide widths (e.g., rectangles), slots with narrow widths (e.g., slots with widths of less than 2 mm, less than 1 mm, less than 0.2 mm, or less than 0.02 mm as examples), openings with compensations of curved and straight sides, etc. These openings need not be formed in overlapping structures such as display structures 14, because the relatively larger conductivity of midplate 52 when compared to display structures 14 ensures that openings 66 in midplate 52 will have a dominating more influence on the pattern of antenna signals emitted from device 10. If desired, however, openings such as openings 66 may be formed in other structures such as in other housing structures (e.g., in parts of bezel 16, in parts of a planar conductive rear housing wall, in parts of internal frame structures other than midplate 52, in display structures 14, etc.). The arrangement of FIG. 4 in which openings 66 are formed in midplate 52 is merely illustrative.

In the arrangement of FIG. 4, each slot 66 is segmented into two parts, separated by a respective break 68. Breaks 68 represent solid portions of midplate 52 where the metal of midplate 52 has not been removed. The inclusion of breaks 68 may help reduce the image-current-blocking effects of slots 66, so that image current I' is not completely blocked (and so that antenna 40 retains a desired efficiency). Breaks 68 may also help preserve the structural integrity of midplate 52, ensuring that midplate 52 and device 10 will be strong enough to withstand the types of impacts and drop events that sometimes occur during use of a portable electronic device.

Figure 5:
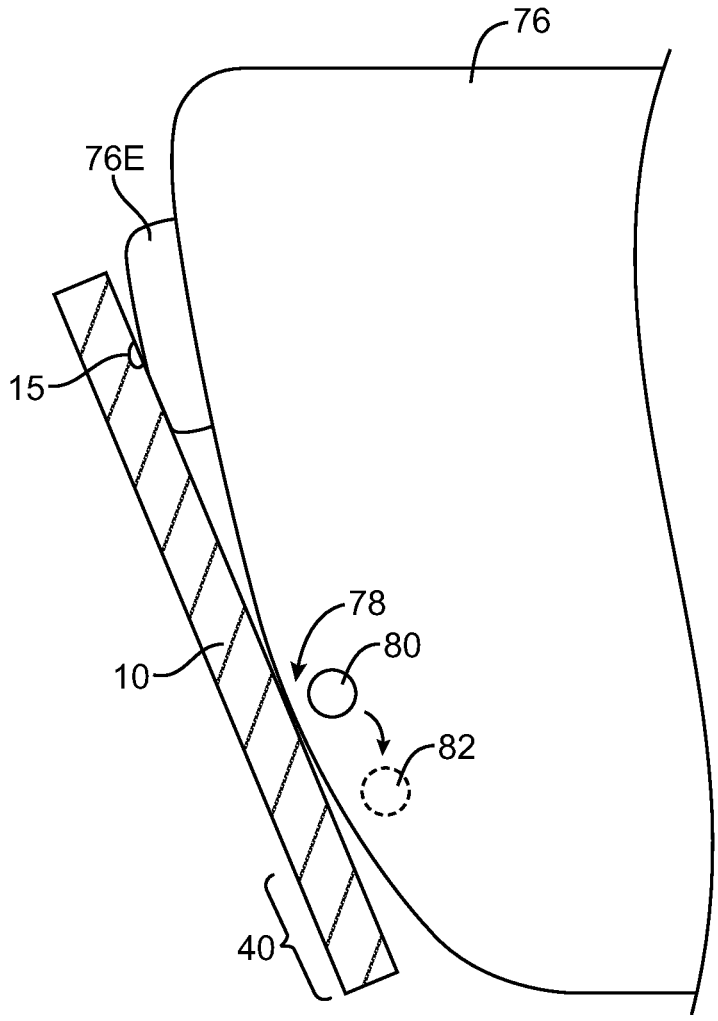
FIG. 5 is a diagram showing how the pattern with which radio-frequency signals are emitted into a specific anthropomorphic mannequin (SAM) phantom during device testing may be adjusted by incorporation of openings in an internal housing structure such as a midplate member in accordance with an embodiment of the present invention.

The inclusion of openings 66 in midplate 52 may help move emitted radio-frequency signals to a desired location in device 10. Consider, as an example, the testing setup of FIG. 5. FIG. 5 is a front view of a specific anthropomorphic mannequin (SAM) phantom of the type that may be used during testing to ensure that device 10 complies with regulatory limits for emitted radio-frequency signal powers.

As shown in FIG. 5, devices such as device 10 are often used in a position in which an ear speaker port such as speaker port 15 rests against a user's ear (modeled using phantom ear structure 76E). While device 10 is maintained in this typical test position, radio-frequency test equipment associated with phantom 76 may be used to measure how much radio-frequency signal power is emitted into phantom 76 from device 10.

In region 78, device 10 typically comes into contact with phantom 76. At this point of contact, the front surface of device 10 (e.g., the outer cover glass associated with display 14) touches the surface of phantom 76. A device with a midplate but no openings 66 might emit radio-frequency signals into absorption region 80. Inclusion of grooves or other openings 66 in midplate 52 of the type shown in FIG. 4 may cause device 10 to emit radio-frequency signals into absorption region 82, rather than region 80.

The signals that are absorbed in region 82 may have a lower power density than the signals that would have been absorbed in region 80. This reduction in absorbed power may partly arise from the disruption in image current I' that is created by including openings 66 in midplate 52. The reduction in absorbed power may also partly arise from the increase in the distance between the surface of device 10 from which the antenna signals are emitted and the corresponding adjacent surface of phantom 76. In the vicinity of absorption region 82 (which is lower down on device 10 and closer to end 40), there is more distance between the front surface of device 10 and the opposing surface of phantom 76 than in the vicinity of absorption region 80.

Because the concentration of power in region 82 is lower than in region 80, transmit signal strength may be increased in antenna 40 while still satisfying regulatory limits for absorbed radio-frequency signals.

Figure 6:
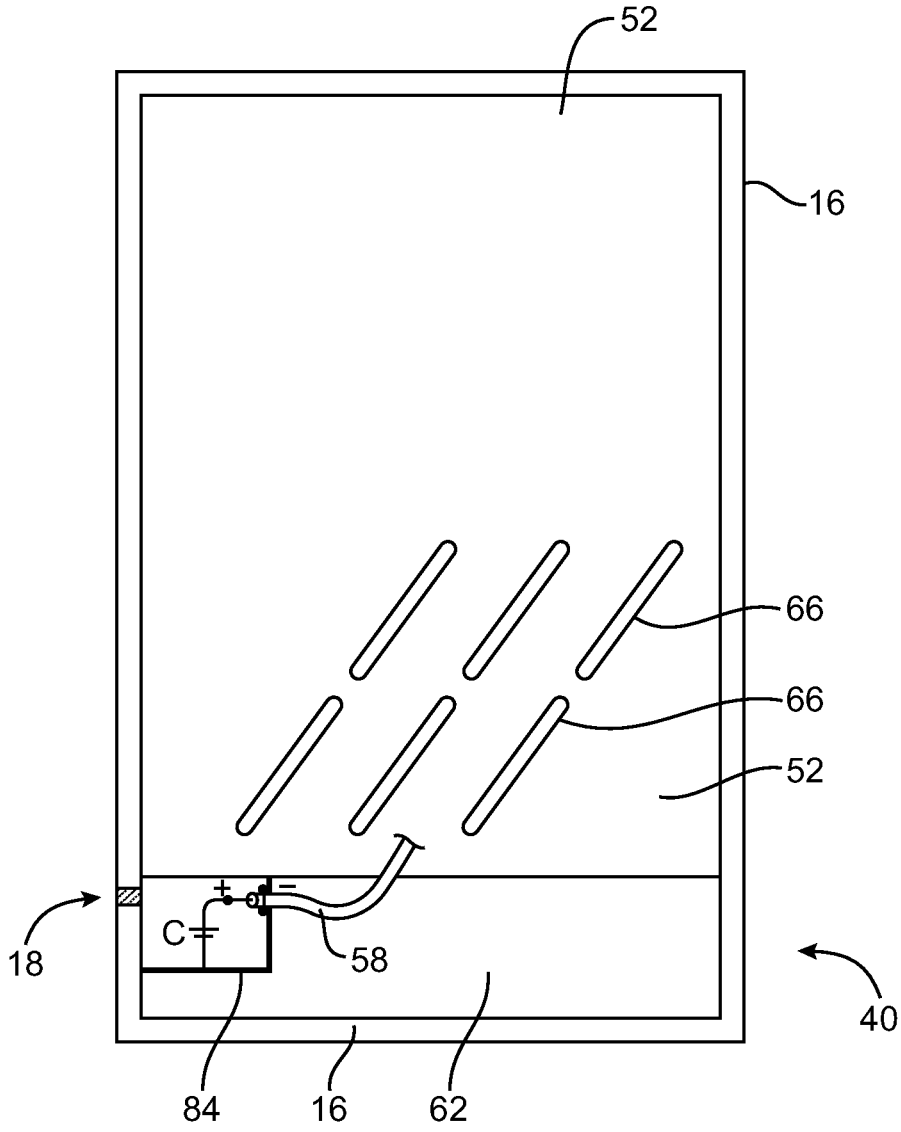
FIG. 6 is a top view of an electronic device showing an illustrative antenna that may be provided with ground plane openings such as internal housing structure grooves in accordance with an embodiment of the present invention.

FIG. 6 shows an illustrative feeding arrangement that may be used for antenna 40. As shown in FIG. 6, antenna 40 may include components such as gap 18, capacitor C (interposed in the antenna feed as a matching element), and conductive segment 84 (which helps tune antenna performance). The antenna structures and feed arrangement of FIG. 6 are merely illustrative. Antenna 40 may be formed from any suitable antenna elements (e.g., patch antenna elements, wires, coils, inverted-F elements, planar inverted-F elements, monopoles, dipoles, strip antennas, slot antennas, loop antennas, antenna structures with combinations of these elements, etc.).

Figure 7:
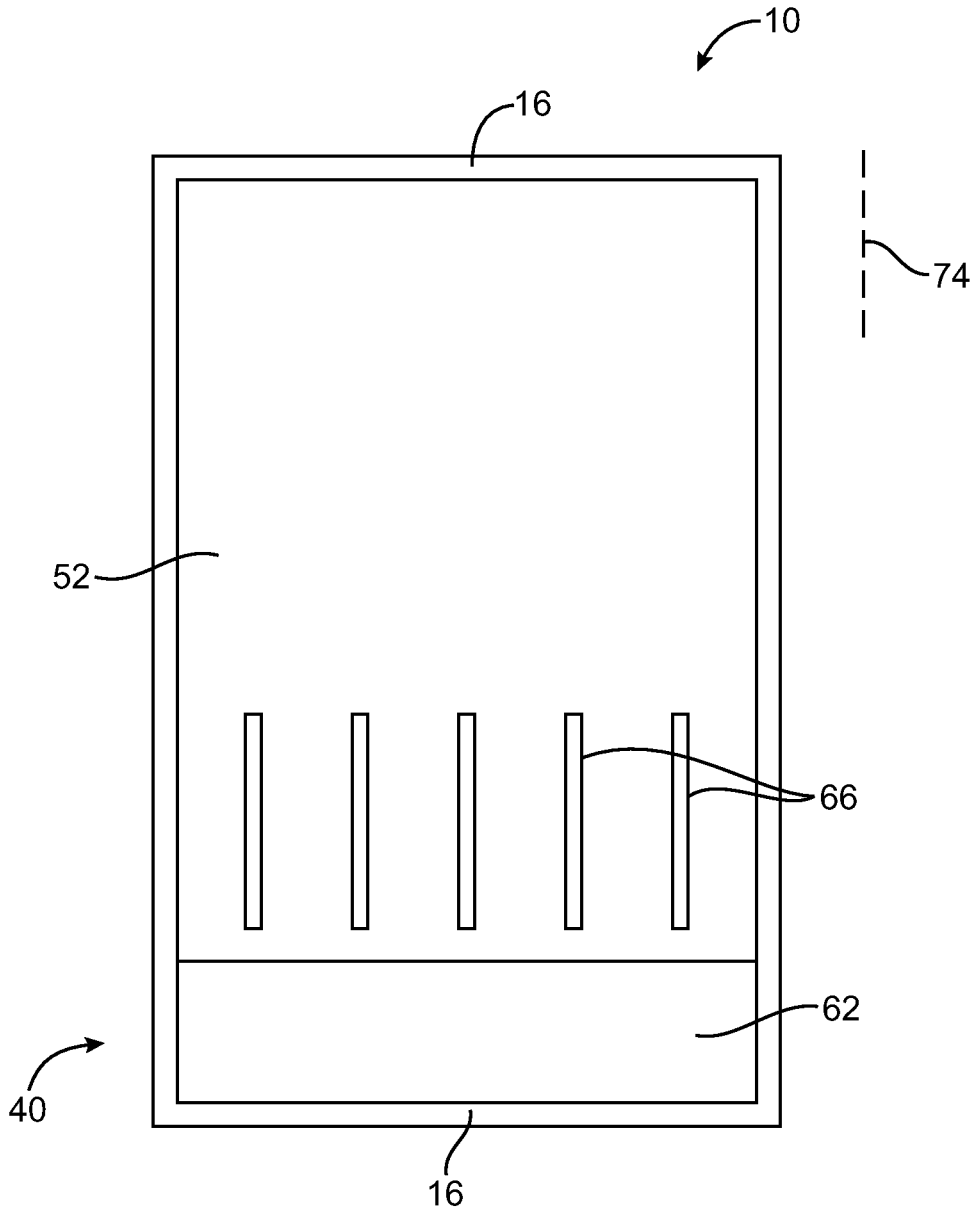
FIG. 7 is a top view of an electronic device showing an illustrative pattern of vertical slots that may be provided in an internal housing support structure in accordance with an embodiment of the present invention.

FIG. 7 is a top view of an illustrative configuration in which slots 66 extend vertically along axis 74. Device 10 may be rectangular and may have a longitudinal axis that runs parallel to axis 74. In this type of configuration, slots 66 may be oriented so that the longitudinal axis of each groove 66 is parallel to the longitudinal axis of device 10. As shown in FIG. 7, slots 66 may be unsegmented (i.e., so that each slot has no breaks 68). If desired, vertically oriented slots 66 may also be provided with breaks.

Figure 8:
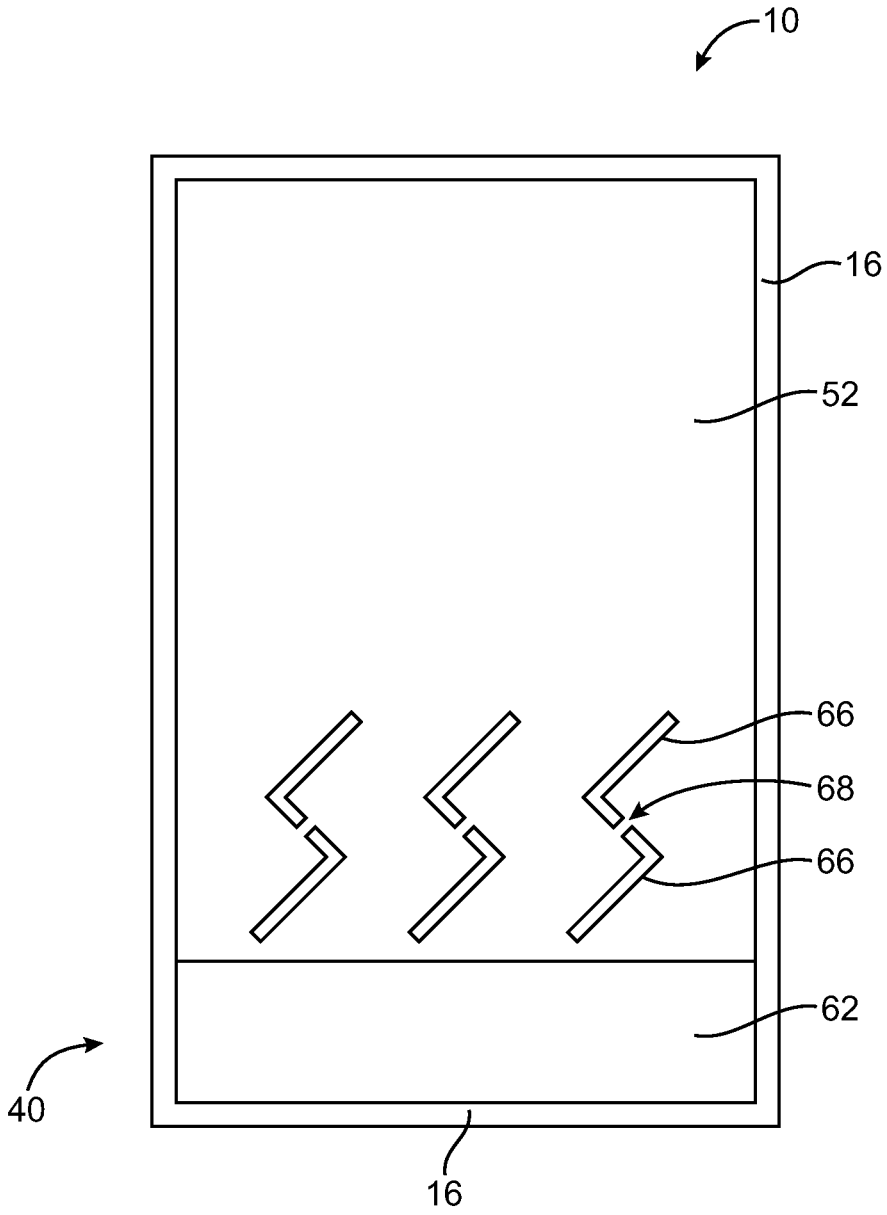
FIG. 8 is a top view of an electronic device showing an illustrative pattern of zig-zag slots that may be provided in an internal housing support structure in accordance with an embodiment of the present invention.
Figure 9:
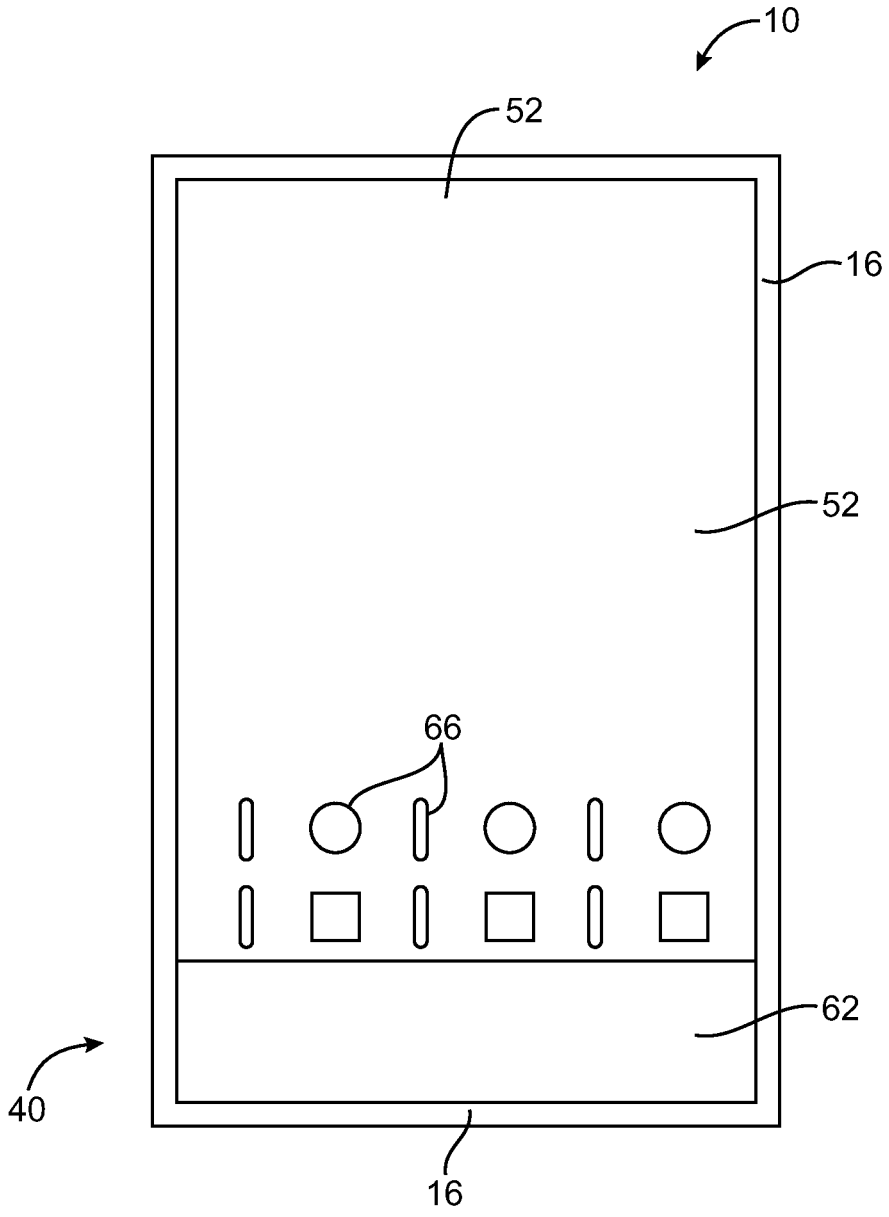
FIG. 9 is a top view of an electronic device showing an illustrative pattern of segmented vertical slots and other openings that may be provided in an internal housing support structure in accordance with an embodiment of the present invention.
Figure 10:
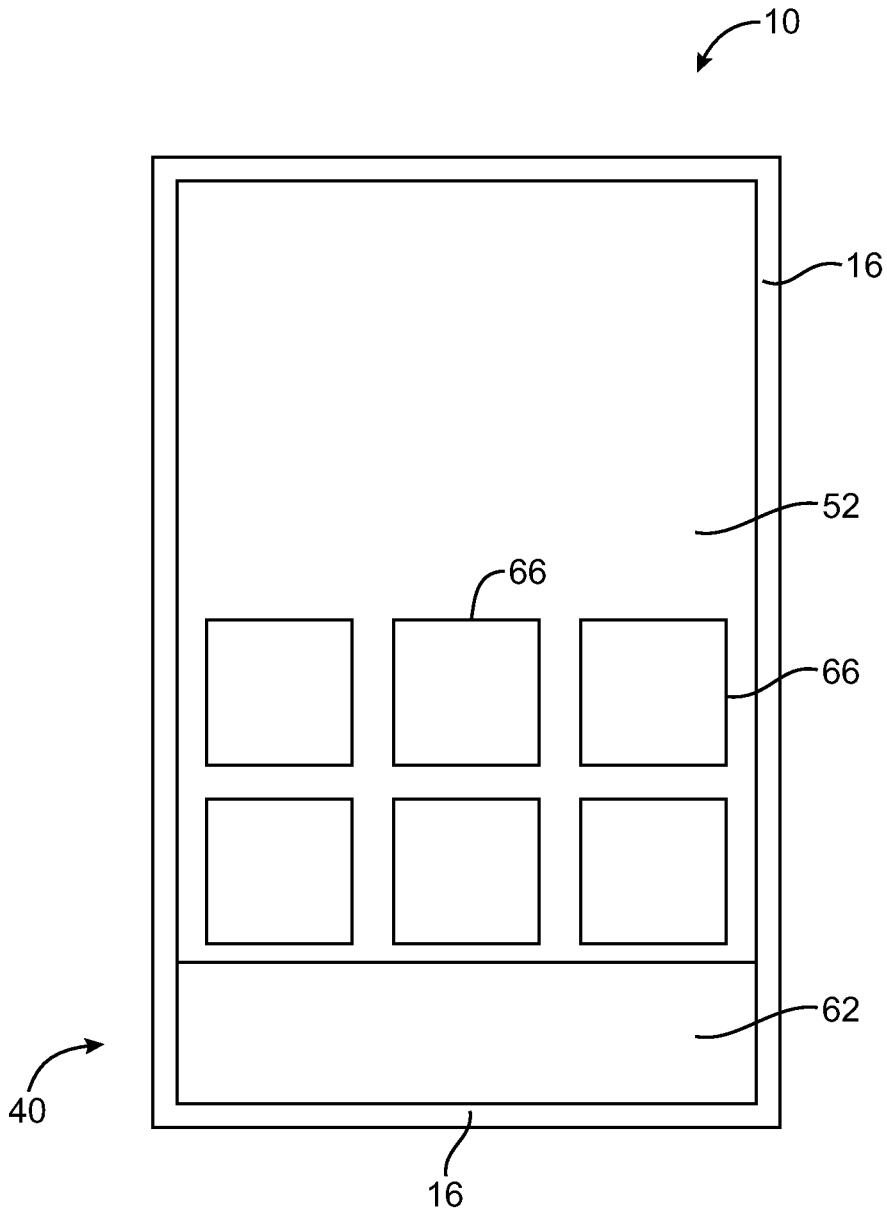
FIG. 10 is a top view of an electronic device showing an illustrative pattern of square openings that may be provided in an internal housing support structure in accordance with an embodiment of the present invention.

In the illustrative configuration of FIG. 8, slots 66 have a zig-zag outline and have associated breaks 68. FIG. 9 shows an illustrative configuration for antenna 40 in which openings 66 have a combination of elongated groove shapes, oval shapes, and polygonal shapes such as rectangles. In the configuration of FIG. 10, midplate 52 has been provided with square openings 66. If desired, other shapes can be used and combinations of these shapes may be used when providing midplate 52 with openings 66. The arrangements of FIGS. 4 and 6-10 are presented as examples.

The foregoing is merely illustrative of the principles of this invention and various modifications can be made by those skilled in the art without departing from the scope and spirit of the invention. The foregoing embodiments may be implemented individually or in any combination.

What is claimed is:

1. An electronic device, comprising:

a rectangular housing having four edges;

an internal metal housing support structure that extends between an opposing pair of the edges, wherein the internal metal housing support structure has at least one opening that does not include any antennas;

a printed circuit board; and an antenna formed from at least part of the metal housing support structure, wherein the antenna produces image currents in the internal metal housing support structure that are influenced by the at least one opening.

2. The electronic device defined in claim 1 wherein the at least one opening comprises a plurality of openings that influence the image currents.

3. The electronic device defined in claim 2 wherein the openings comprise slots.

4. The electronic device defined in claim 3 wherein the electronic device has a vertical longitudinal axis and a horizontal axis that is orthogonal to the vertical longitudinal axis and wherein the slots each have a respective longitudinal axis that is oriented diagonally with respect to the vertical axis and the horizontal axis.

5. The electronic device defined in claim 1 wherein the at least one opening comprises a plurality of segmented slots, each slot having at least a first portion and a second portion separated by a break in which part of the metal housing support structure is present.

6. The electronic device defined in claim 1 wherein the electronic device comprises a display and a conductive bezel that surrounds at least part of the display and wherein the antenna includes at least part of the conductive bezel.

7. The electronic device defined in claim 1 wherein a conductive member runs along substantially all of the four edges, so that a dielectric region is formed between at least a given portion of the conductive member and the internal metal housing support structure and wherein the antenna is formed from the given portion of the conductive member and a portion of the internal metal housing support structure on an opposing side of the dielectric region.

8. The electronic device defined in claim 7 wherein the internal metal housing support structure comprises a metal plate.

9. The electronic device defined in claim 8 wherein the at least one opening comprises a plurality of slots in the plate.

10. The electronic device defined in claim 8 wherein the at least one opening comprises a plurality of slots in the plate and wherein the electronic device further comprises:

a display that rests on the plate and that is supported by the plate.

11. The electronic device defined in claim 10 wherein the slots are oriented at a non-zero angle with respect to the edges and are segmented.

12. The electronic device defined in claim 8 wherein the electronic device comprises a cellular telephone transceiver coupled to the antenna.

13. Antenna structures in an electronic device, comprising:

a portion of a display bezel; and a portion of an internal metal housing plate in the electronic device, wherein the internal metal housing plate is connected to the display bezel and comprises a plurality of slots that block image currents in the internal metal housing plate when antenna signals are transmitted by the antenna structures, and wherein the slots are surrounded and enclosed by the internal metal housing plate.

14. The antenna structures defined in claim 13 wherein the slots comprise a plurality of elongated slots.

15. The antenna structures defined in claim 14 wherein the slots are segmented slots having breaks.

16. The antenna structures defined in claim 13 wherein the display bezel comprises a metal housing structure that has four edges that run along four respective sides of a rectangular display in the electronic device and wherein the internal metal housing plate comprises a planer metal support member that extends between an opposing pair of the edges and that supports the rectangular display.

17. An electronic device, comprising:

a rectangular housing having four edges;

a conductive metal member that runs along the four edges of the rectangular housing;

a metal plate that is connected between a pair of opposing edges of the conductive metal member; and an antenna formed at least partly from a portion of the conductive metal member and a portion of the metal plate, wherein the metal plate has a plurality of elongated slots adjacent to the antenna, and wherein the plurality of elongated slots are oriented at a non-zero angle with respect to the four edges of the rectangular housing.

18. The electronic device defined in claim 17 wherein the elongated slots have breaks and wherein the elongated slots block antenna image currents in the metal plate.

19. The electronic device defined in claim 17 further comprising a display that overlaps the plurality of elongated slots and is supported by the metal plate.

20. The electronic device defined in claim 19 wherein the metal plate and the portion of the conductive metal member are separated by a dielectric region and wherein the conductive metal member comprises a bezel that surrounds the display.

* * * * *